US007673692B2

(12) United States Patent
Kunz

(10) Patent No.: US 7,673,692 B2
(45) Date of Patent: Mar. 9, 2010

(54) EUTECTIC MATERIAL-BASED SEAL ELEMENT FOR PACKERS

(75) Inventor: Dale Ian Kunz, Calgary (CA)

(73) Assignee: BJ Tool Services Ltd., Calgary (CA)

( * ) Notice: Subject to any disclaimer, the term of this patent is extended or adjusted under 35 U.S.C. 154(b) by 138 days.

(21) Appl. No.: 11/676,191

(22) Filed: Feb. 16, 2007

(65) Prior Publication Data

US 2007/0199693 A1 Aug. 30, 2007

Related U.S. Application Data

(60) Provisional application No. 60/774,688, filed on Feb. 17, 2006.

(51) Int. Cl.
*E21B 33/12* (2006.01)

(52) U.S. Cl. ..... 166/387; 166/122; 166/187; 166/277

(58) Field of Classification Search ..... 166/179, 166/120, 122, 187, 387, 277
See application file for complete search history.

(56) References Cited

U.S. PATENT DOCUMENTS

| | | | | |
|---|---|---|---|---|
| 3,314,479 | A * | 4/1967 | Mccullough et. al. | 166/63 |
| 4,573,537 | A | 3/1986 | Hirasuna et al. | |
| 4,923,007 | A | 5/1990 | Sanford et al. | |
| 5,819,846 | A | 10/1998 | Bolt, Jr. | |
| 5,833,001 | A * | 11/1998 | Song et al. | 166/287 |
| 6,474,414 | B1 | 11/2002 | Gonzalez et al. | |
| 7,234,533 | B2 * | 6/2007 | Gambier | 166/387 |
| 7,290,609 | B2 * | 11/2007 | Wardlaw et al. | 166/277 |
| 2002/0056553 | A1 * | 5/2002 | Duhon et al. | 166/302 |
| 2007/0051514 | A1 * | 3/2007 | La Rovere | 166/277 |

* cited by examiner

*Primary Examiner*—William P Neuder
*Assistant Examiner*—Nicole A Coy
(74) *Attorney, Agent, or Firm*—Bennett Jones LLP

(57) ABSTRACT

The present invention relates to a seal element for a wellbore which includes a support member, a bag positioned on the support member and a eutectic material positionable in the bag. The bag may be axially compressed and axially extended along the support member thereby permitting sealing and unsealing of an annulus in a wellbore. The eutectic material may be a phase changing salt.

19 Claims, 3 Drawing Sheets

EUTECTIC MATERIAL-BASED SEAL ELEMENT FOR PACKERS

FIELD OF THE INVENTION

The invention relates to a seal element and, in particular, a seal element commonly known as a packer or a patch for use in wellbore operations.

BACKGROUND OF THE INVENTION

Within the context of petroleum drilling and completion systems, existing methods to provide hydraulic isolation (sealing) between portions of a wellbore or wellbore annulus, whether cased or open, may be broadly divided into two types of seal element: 1) bulk expansion (compression-set); and 2) inflatable. Devices employing either of these element methods are commonly referred to as either bridge plugs or packers, depending respectively, on whether full cross-sectional or annular closure is ultimately required. Since closure of an annular space with respect to the device is always required, the term "packer" is employed here to refer generally to all such devices.

Both bulk expansion and inflatable seal elements must provide sufficient annular clearance firstly to permit insertion into the wellbore to the desired depth or location, and secondly a means to subsequently close this annular clearance to affect an adequate degree of sealing against a pressure differential. It is often also desirable to retract or remove these devices without milling or machining.

Devices relying on bulk expansion of the seal element typically employ largely incompressible but highly deformable materials such as elastomers as the sealing element or element "stack". The seal is generally cylindrically or toroidally shaped, and is carried on an inner mandrel. U.S. Pat. Nos. 5,819,846 and 4,573,537 are two examples of such devices using an elastomer and ductile metal (non-elastomeric), respectively, for the deformable seal element material. In these cases, the seal is formed by imposing axial compressive displacement of the element which causes the material to incompressibly expand radially (inward or outward or both) to close off either annular region. After confinement is achieved, sufficient pre-stress is applied to promote sealing.

The amount of annular expansion and sealing achievable with elastomers is dependent on several variables but is generally limited by the extrusion gap allowed by the running clearance. The size of annular gap sealable with ductile metals is similarly limited, although for slightly different reasons: since the deformation is largely irreversible, the size presents a further impediment to retrieval. For either elastomers or ductile metals, practically achievable axial-seal lengths are also short—in the order of a few inches. Therefore, sealing on rough surfaces is not readily achievable. This limitation to sealing small clearances with relatively short seal lengths and limited conformability even for elastomers tends to preclude using the method for sealing against most open-bore-hole surfaces. Furthermore, this style of device usually also provides a means to retract axial load, e.g., slips, separate from the sealing element.

Such axial loads arise from pressure differentials acting on the sealed area, plus loads transmitted by attached or contacting members and typically exceed either the frictional or strength capacity of the seal material. This is especially true as the sealed area (hole diameter) is increased. Managing the setting and possible release of the associated anchoring systems adds considerable complexity to these devices, along with increased cost and reliability issues. Similarly, the degree of complexity, cost and uncertainty is further increased where the application requires axial-load reversal that arises when the pressure differential may be in either direction. Both the sealing and mechanical-retaining hardware tend to require significant annular space. Therefore, the maximum internal-bore diameter is significantly smaller than the setting diameter.

Devices relying on inflation of the "membrane" seal element employ a generally cylindrical sealing element (visualize a hose), capable of expanding radially outward when pressured the inside with a fluid. The sealing element is carried on a mandrel with the end-closure means to contain pressure and to accommodate whatever axial displacement is required during inflation. The sealing element in these devices is typically of composite construction where an elastomer is reinforced by stiffer materials such as fibre strands, wire, cable, or metal strips (also commonly referred to as "slats").

U.S. Pat. No. 4,923,007 is an example of a device employing axially aligned overlapping metal strips. Pressure containment by these elements relies largely on membrane action where the sealing element may be considerably longer and more conformable than in bulk expansion devices. Inflation packers are therefore most commonly employed for sealing against the open-bore-hole wall. The inflation material may be a gas, liquid or "setting" liquid such as cement slurry. Where the inflation material stays fluid, pressure must be continuously maintained to affect a seal. If the device develops a leak after inflating, the sealing function will be lost. To circumvent this weakness, a setting liquid such as cement is used. Therefore, pressure need only be maintained until sufficient strength is reached. However, the device then becomes much more difficult to remove since it cannot be retracted through reverse flow of the inflation fluid. Typically, the device can only be removed by machining and milling.

As with the bulk expansion method, the membrane strength of inflatable packers significantly limits the ability to react axial load and the annular space requirements of membrane end seals and mandrel can be quite large. Therefore, inflatable packer elements tend to suffer from the same limited axial load and through bore capacities as bulk expansion packer elements.

SUMMARY OF THE INVENTION

In accordance with a broad aspect of the present invention, there is provided a seal element for a wellbore comprising: a support member; a bag positioned on the support member; and a eutectic salt material positionable in the bag.

In accordance with another broad aspect of the present invention, there is provided a seal element for a wellbore comprising: a support member; a bag carried on the support member and being inelastic; a eutectic material positionable in the bag; and a mechanism for at least one of (i) axially compressing and (ii) axially extending the bag along the support member.

In accordance with another broad aspect of the present invention, there is provided a method of sealing a wellbore comprising: positioning a bag in a wellbore in an axially extended position on a support member; providing a eutectic material contained in the bag; allowing the bag to flex out away from the support member and assume a flexed condition; and allowing the eutectic material to harden in the bag during the flexed condition.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION

Figure 1A:
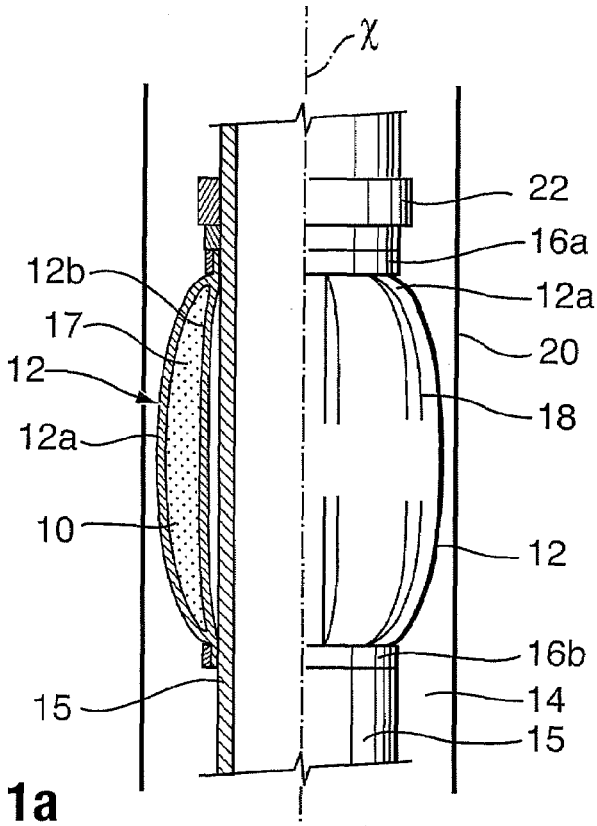
FIG. 1*a* is a schematic sectional view of a eutectic seal element in an open (i.e. unsealed) configuration in a wellbore.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The invention uses of "phase-changing salts", technically known as eutectic materials, as re-settable salt plugs for use in sealing a wellbore annulus. The eutectic material is contained in a bag which is sturdy enough to withstand the abrasion of service in the wellbore. By heating and cooling the salt plug, the seal can be set and unset, for example, to open or close an annulus in a wellbore, such as between the production tubing and the well casing, or in open-hole structures between the coil or wireline system and the wellbore wall. Alternately, the seal can be used to create patches that can be set and removed.

While meeting similar functional objectives and thus acting as a packer in the generic sense, the present invention introduces a novel type of packer architecture. This architecture may be described as a membrane seal element packer, wherein the element is capable of being expanded by the melting of a solid salt material. The device can be used in a variety of downhole applications, is amenable to either open or cased-hole applications, is retrievable, and has a symmetric response to direction of axial loading. The membrane seal packer may be used to seal an annulus or may be used to create a patch in the casing.

Eutectic salts are sometimes referred to as "phase-changing salts" or phase-changing material. Eutectic materials are characterized by forming very regular crystalline molecular lattices in the solid phase. Eutectic materials are chemical compounds that have the physical characteristic of changing phase (melting or solidifying) at varying temperatures: melting at one temperature and solidifying at another. The temperature range between which the melting or solidification occurs is dependent on the composition of the eutectic material. When two or more of these materials are combined, the eutectic melting point is lower than the melting temperature of any of the composite compounds. The composite material is approximately twice as dense as water, weighing approximately 120 pounds per cubic foot. Salt-based eutectic material can be formulated to work at temperatures as low as 30° F. and as high as 1100° F. Metal-based eutectic materials can operate at temperatures exceeding 1900° F.

When solid eutectic material is heated to the fusion (melting) point, it changes phase to a liquid state. As it melts, it absorbs latent heat. When the temperature of the eutectic liquid solution phase is lowered to below the melting point, it does not solidify, but becomes a "super-cooled" liquid. The temperature must be lowered to the eutectic point before it will change phase back to a solid. When the temperature is lowered to the eutectic temperature, the liquid-to-solid phase change occurs almost instantaneously, and forms a homogenous crystalline solid with significant mechanical strength.

The phase change from super-cooled liquid to solid can also be triggered by inducing the initiation of the crystalline process. This may be accomplished by introducing free electrons into the liquid by various means, for example, by deformation of a piece of electrically conductive metal.

Phase-changing salts are extremely stable. If they are not heated above their maximum operating temperature range, it is believed that they may operate indefinitely. At least some eutectic salts are environmentally safe, non-corrosive, and water-soluble. Moreover, as the working-temperature range of the eutectic salt may increase, the strength of the crystal lattice may increase and the physical hardness of the solid phase may increase.

Referring to FIG. 1, to provide a seal element for a wellbore, eutectic material 10 may be contained in a durable, flexible, bladder or bag 12 that will contain material 10, but flex to allow the bag and the liquid salt therein to take the shape of the annulus 14. The bag is positioned in proximity, for example mounted about, a support member 15. The support member may have an axial dimension, indicated by axis x. Support member 15 may be a tubular mandrel as shown or may take other forms, as desired. Support member 15 and bag 12 carried thereon may be sized to fit into a wellbore, such as into a wellbore casing 20, as shown, into an annulus, an open hole wellbore, etc.

The size of the bag may vary depending on the application, but generally the bag is sized to contain the proper amount of eutectic material to achieve the necessary sized plug capable of creating a seal against the differential pressure.

The bag may be sealed to contain the eutectic and to protect the eutectic from contamination. The bag seals may be provided by forming the bag continuously to create an interior chamber fully enclosed by the bag. Alternately, the bag may be sealed by sealing the bag against another member such as support member 15. In the illustrated embodiment, for example, the bag contains the eutectic by forming the bag with an outer wall 12*a* and an inner wall 12*b* with an inner chamber 17 defined therebetween. The bag may be manufactured from sheet material durable enough to withstand the abrasion, contact with chemicals and temperatures of service in the wellbore, and which is inelastic so that it is unable to flex or stretch when held taut, but may flex when it is held loosely. High temperature-tolerant material such as fluoroelastomer (FTPE™), fluoropolymer (TEFLON™), fiberglass, poly-paraphenylene terephthalamide (KEVLAR™), poly p-phenylenediamine (NOMEX™) for example or blends of these materials, may be used. One example of a suitable material is a woven TEFLON™ coated KEVLAR™. Such a material may be heated to melt the TEFLON™ to encapsulate the KEVLAR™. This blend is inelastic due to the presence of KEVLAR™ and may be leak proof and sufficiently durable to prevent tear or wear by abrasion.

The bag may be carried on the support member in various ways such as by retainers 16*a* and 16*b* such as clamps, ties, clips, sleeves, fasteners, etc. Retainers 16*a*, 16*b* each secure an end of the bag and mount the bag on support member 15.

The bag controls the shape of the eutectic material contained within it. In one embodiment, the shape of the bag may be adjustable so that the flow and the position of the liquid phase material can be controlled. The bag may be pleated for example with longitudinal pleats 18 extending from the top of the bag 12*a* to the bottom of the bag 12*b* to allow for expansion of the bag. Thus in one embodiment, one or both retainers 16*a*, 16*b* may be axially slideable along the member so that the bag can be elongated axially and pulled out along the support or allowed to hang more loosely on the support such that the bag is able to flex out away from the support member. In one embodiment, it may be useful to allow for adjusting the condition of the bag to move it between a taut position and a flexed condition. The taut condition may allow the bag and any eutectic therein to be held against the support member to control its outer diameter to facilitate tripping through the wellbore and the flexed condition may allow the bag to flex out to fill the area to be sealed in the wellbore. To do so, one or both retainers 16*a* and 16*b* may be driveable along the support member toward or away from each other. The retainers may be driven in various ways to change the condition of the bag. For example, a piston 22 may be provided that can be driven by pressure to drive retainer 16*a* toward retainer 16*b*. It is also possible to use threaded actuators, wireline pull mechanisms, or torque set actuators, for example, to drive the bag from its axially extended to an axially compressed or flexed condition. As will be discussed below, it is also possible to use a metallic coil inside the bag to change the shape of the bag. The retainers also allow the bag to be removeable from the wellbore.

A variety of eutectic compositions are suitable for use, including any eutectic material that is capable of forming a plug having sufficient strength to withstand the pressure differential across the plug. For example, a salt that would melt at over 300° C. and solidify at 260° C. may be suitable. A useful eutectic phase changing salt may include mixtures of NaCl, KCl, $CaCl_2$, $KNO_3$ and $NaNO_3$. In one embodiment, for example, a high temperature draw salt may be useful such as for example 430 Parkettes® (Heatbath Corporation). As these salts are water-soluble and environmentally safe, they would not pose a problem should leakage occur. It is also possible to use mixtures of three components. An aggregate such as a microglass bead or a glass fibre may be used to act as a reinforcement to increase the mechanical strength of the salt.

The eutectic material may be introduced into the bag at surface and run the seal element run into place with the eutectic material contained in the bag. Alternately, the eutectic material may be introduced to the bag downhole such as by injection of a liquid through a conduit and valve into the bag. For example, the eutectic may be provided in support member 15 and when the seal is in a selected position within the wellbore, the eutectic may be liquefied and injected from the support member into the bag. Pistons, etc. may be used to drive the injection of the eutectic.

By controlling the temperature at which the salt changes from solid to liquid, and by selecting the shape of the bag, the bag may be used to create a seal in a wellbore such as an annulus. The length of the salt plug and the composition of the salt material may be varied such that the various differential pressures may be sealed.

In operation, the bag with eutectic material may work much like a conventional inflatable packer in that the bag expands and contracts to open or close the annulus. The highly adaptable shape of the liquid-filled bag may accommodate eccentric conditions and oval deformation in the casing, and thus, may effectively seal across threaded joints, washouts or pits, for example. The bag may be used in open-hole applications, but has several other applications including use in permanent installations in thermally stimulated wells and in well servicing jobs where it is may be employed as a temporary tool on conventional tubing, coil tubing, rod strings or wireline.

Figure 1B:
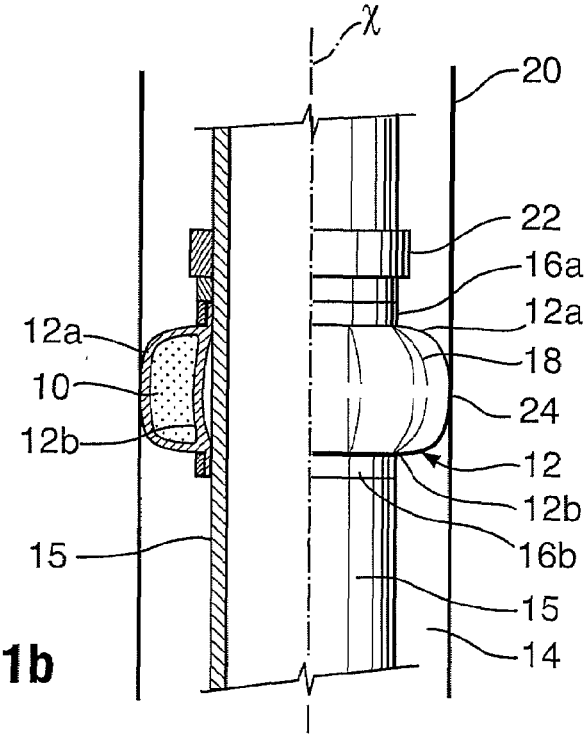
FIG. 1*b* is a schematic sectional view of a eutectic seal element in a closed (i.e. sealed) configuration) in a wellbore.

Axially extending the bag effectively decreases the diameter of the eutectic seal element. The effect of this elongation is to stretch the bag along the axis of the support member, reducing its outer diameter. When the retainers are slid apart along the length of the tubing, the eutectic material can be solidified to hold the bag in a limited diameter against support member 15 (FIG. 1*a*). If the eutectic is in liquid form and the retainers are slid toward each other along the length of the support member, the bag can flex out to increase in diameter (FIG. 1*b*). If the eutectic is then solidified with the bag in this condition, the diameter of the bag can be effectively increased. Such a condition can be used to create a seal in the well bore, for example, in an annulus about the seal element. The bag forms a contact region 24 with the inner wall of the wellbore. When the temperature is increased, the salt melts to open the annular space. The bag may remain in place as the eutectic material can be solidified and liquidified repeatedly to seal and open the wellbore. Alternately, once the eutectic is melted to unset the seal, the bag can be removed from the annulus. If desired to facilitate movement of the seal element within the wellbore, it may be useful to move the retainers away from each other to again stretch the bag and reduce its diameter. If desired, the eutectic may then be solidified to set the bag in its axially extended position.

Figure 2A:
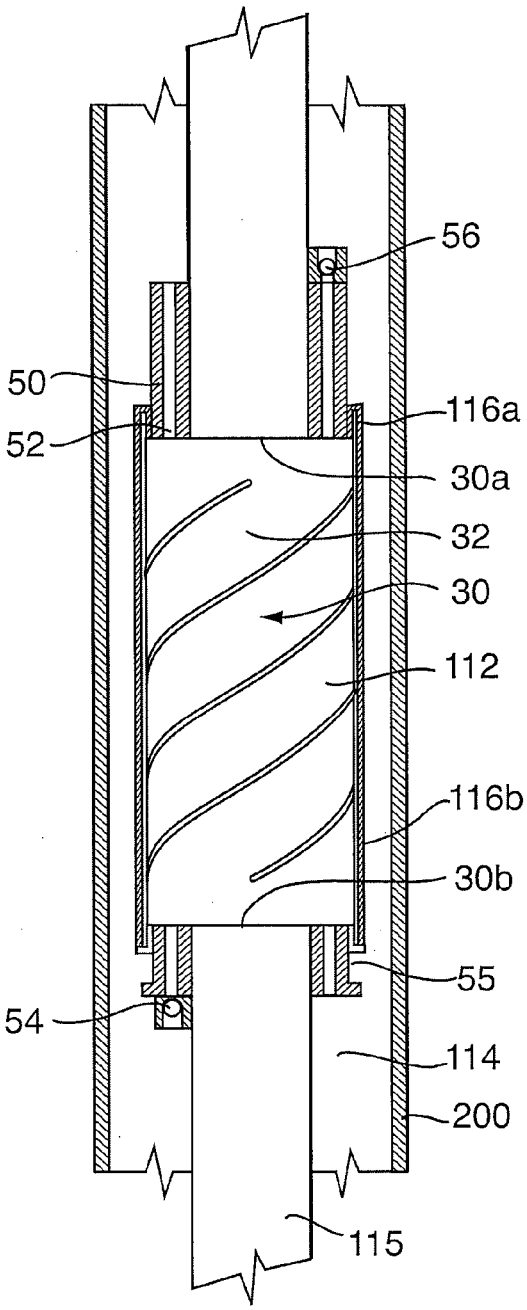
FIG. 2*a* is a schematic front elevation view of a eutectic seal element in an open (i.e. unsealed) configuration in a wellbore with bag cutaway to show expansion tube.

Referring to FIG. 2, another seal element according to the present invention may include a bag 112 and a mechanism to drive the bag between its axially extended and axially compressed positions in response to temperature conditions to which the seal element is exposed. In the illustrated embodiment, the mechanism may include a temperature responsive material that expands and contracts in response to temperature conditions.

In the illustrated embodiment for example, the seal element includes an expansion tube 30 including helical slots 32 or in the form of a coil spring. The tube can expand in length when heated, due to the operation of slots 32 causing the tube to twist axially, and contracts to its original length when the temperature about the tube is reduced. The expansion tube may be mounted on a tubular member 115 or other support member to remain substantially in position but in such a way that elongation can occur. In the illustrated embodiment, for example, expansion tube 30 is installed at its lower end and can expand along the tubular member in one direction only upwardly along member 115.

The expansion tube may be made of a material with a high thermal coefficient of expansion that will lengthen when heated. As such, the expansion tube may be comprised of slotted metal, or may be comprised of bimetallic composite material such as a steel brass laminate.

Figure 2B:
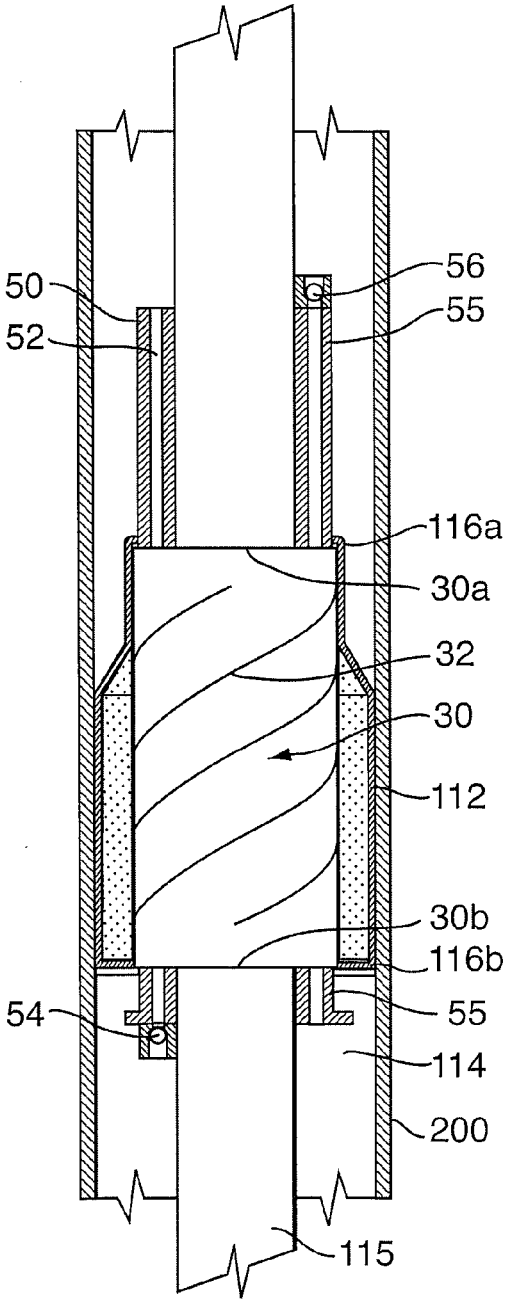
FIG. 2*b* a schematic front elevation view of the eutectic seal element shown in FIG. 2*a* in a closed (i.e. sealed) configuration in a wellbore.

Bag 112 may be fastened using retainers 116*a*, 116*b* such as clamps to tube 30 in two spaced apart positions, for example adjacent its upper 30*a* and lower 30*b* ends, so that bag moves with the expansion and contraction of tube 30. The coil spring inside the tube twists as it lengthens and when it lengthens, the bag becomes untwisted as well. As such, axial extension or contraction and twisting of the tube, effectively increases or decreases the diameter of the eutectic seal element. The effect of this elongation is to stretch the bag along the axis of the tool, reducing its outer diameter. When tube 30 is allowed to axially compress, the bag become more loosely held and can flex to increase in diameter. The eutectic in the bag is likewise allowed to flow with the various conditions of the bag, such that when the tube contracts, the eutectic can flow to fill out the bag and when solidified therein seal an annulus 114 about the tubular member, as shown in FIG. 2*b*. In the illustrated embodiment, the seal element is positioned in a wellbore casing 200 and can flow out to fill the annular space between tubular member 115 and casing 200.

The seal element may include a heat source positioned in proximity to the bag. In the embodiment shown in FIG. 2, this heat source may be a heat-exchanger 50 used with high-temperature fluids or vapors, such as steam. In the embodiment shown in FIG. 2, the heat exchanger is positioned to extend alongside the bag and in particular, between tubular member 115 and expansion tube 30, while bag 112 is positioned externally about tube 30. However, other configurations of the heater are possible. For example, the heater can be positioned within the tubing, in the wall of the tubing, external to the bag, internal of the bag or between the walls of a double-walled bag. Further, the heater may take various forms and employ various technologies. The heat exchanger may have passages 52 for heat transfer. Flow- or pressure-control valves 54 may be used to control flow through passages 52 or for conducting pressure tests.

Alternately, the heat source may also be electrical. In an electrical heat system, the heat may be provided by an electric-resistance heater and the flow of electric current may be controlled to adjust the temperature.

A heat source may be useful in an embodiment where the eutectic is conveyed downhole external to the bag and injected into the bag at an appropriate time. In such an embodiment, a heat source may be used to selectively heat and melt the eutectic material prior to injection through into the bag.

A seal element according to the present invention may further include one or more bypass conduit 55 for allowing controlled passage of fluids upwardly therepast, such as may be useful to prevent pressure locks. Bypass conduit 55 may include a valve 56 to control flow therethrough.

Applications

Components of a eutectic seal element can be changed to suit the application. For example, the salt composition can be selected to suit higher or lower operational temperature ranges and/or to produce increased or decreased mechanical strengths. The bag materials can also be changed for higher or lower temperature ranges, increased sealing capacity or durability. Liquidification and solidification of the eutectic can be driven by downhole conditions such as the presence of steam, other high-temperature gas or fluid, or a heat source can be employed such as a heat exchanger, electric heater, etc.

Thermally Stimulated Well Application

Thermally stimulated wells, using high pressure steam ("huff and puff injection") as the heat transfer medium, may be subjected to unpredictable well-casing failures. These failures may be caused by the cyclical temperature extremes from 650° F. to 150° F., between the steam injection and production phases of the well cycle. Thermal stresses of such extremes may act to gradually reduce the torque on threaded casing joints, resulting in parting at the joint and leakage. Existing packer technology may not serve well in this application due to the use of temperatures beyond which current elastomer technology can normally operate.

A steam injection well production cycle typically has four steps:

1) Steam injection: steam is injected into the well through the tubing/casing annulus for a specified time or volume;

2) Steam soak: the steam injection is shut off and the heat energy is allowed to permeate the formation;

3) Well flowing: the production line is opened and the well flows to surface due to pressure built up in the reservoir by steam; and 4) Well pumping: once the reservoir pressure is depleted to the point that the well will no longer flow, the rod pump is turned on and the well is pumped until the pump loses efficiency.

Once the pump loses efficiency, the well is shut in and the production cycle is started over again.

The eutectic seal element may be specifically designed for high temperatures. The eutectic seal element captures the energy in the high temperature environment to operate the tool. Therefore, the present eutectic seal element may be used in the huff and puff system.

A eutectic seal element, such as that shown in FIG. 2 for example, may be installed on the production tubing of a well and positioned, for example, so that it will protect the casing from the top of the producing zone to the surface.

In permanent installations, it may be efficient to manufacture the eutectic seal assembly can be installed as an external sleeve and bolted in place on the production tubing. For example, a mandrel sub may be installed in the tubing string and once it is in place, the seal assembly including expansion tube 30 and bag 112 containing the salt can be slid over the end of the mandrel, positioned and clamped in place. The eutectic seal element may then be heated to the operating temperature and tested for function. For installation, the expansion tube may be restrained in the extended position so that when the system cools and the salt solidifies, the expansion tube and, therefore, the bag is held in the axially extended position. In this way, although the wellbore conditions may be below the expansion temperature of tube 30, the eutectic seal element may be maintained at the smallest diameter for ease of installation into the wellbore.

Once the tubing string with eutectic seal element thereon, is in place in the wellbore, steam as shown by the arrow S, may be flowed through the tubing/casing annulus to heat the seal element. The steam melts the salt which allows release of the expansion tube. The steam is shut off allowing the system to cool, the expansion tube to shrink, and the salt filled bag to flex and expand out to seal the annulus. The salt will then solidify in this condition.

For example, the operation sequence of the eutectic seal element installed in a steam stimulated well may be as follows:

1. A casing integrity pressure test may be performed against the expanded seal element (salt in solid phase; bag expanded and sealing annulus). Steam condensate (water) flooding the annulus may be pressurized using a pump attached at the wellhead.
2. The pressure may then be increased slightly to open a pressure relief valve 54 in heat exchange tube 50. This permits condensate to flow through the heat exchange tube 50.
3. Steam is admitted to the annulus above the packer and passes through heat exchange tube 50.

4. The steam raises the temperature of the salt to the melting point and heats the helically cut tube inside the bag, causing it to axially lengthen and rotate. This decreases the bag radial profile and results in the opening up the annulus. When the annulus is open, this allows full steam flow to pass unobstructed to the reservoir. As long as the steam is flowing in the annulus past the seal element, the temperature remains high, the salt remains liquid and the seal element stays open.
5. At the end of the steam injection cycle, the steam is shut off. The seal element begins to cool. The cooling helically slotted tube contract in length, drawing the bag to shortens and allowing it to flex out away from the production tubing. This also allows the liquid salt to fill the annulus. At the end of the helix tube travel, temperature triggers the phase change and the liquid rapidly changes phase back to a solid and reseals the annulus.
6. Small-diameter vent line 55, for example, that may be flow-rate restricted by integral check valve 56, may allow gases and steam to escape into the annulus from the reservoir. The valve may close if the flow exceeds a set maximum.
7. The seal element may remain in place providing annular isolation until the next steam cycle begins.
8. The components are all robust and the system may provide service equal to the life of the well with little or no maintenance.

Well Servicing Operation Application

The eutectic seal element system can be deployed in well servicing operations using conventional service rigs that employ tubular strings, coil tubing or wireline. Operations such as fracturing, hot oiling, acidizing and perforating can be performed using the seal element in the same way that conventional packers are used. The seal element may be used in situations where pumping equipment is not on site, or where through-tubing deployment will reduce costs, for example.

The eutectic seal element may use an electrical heating system, supplied with current from a generator or a storage battery. Eutectic salt is contained in the bag, along with a helically cut expansion tube designed to control the bags shape when it is heated and cooled. The bag may be attached to a one-piece tubular mandrel, for example. The seal element may be attached to coil tubing, for example. Alternatively, the seal element may be wireline deployable.

The seal element may be run into the hole with the salt solidified in the system in the extended, minimal-radial-diameter configuration. When the seal element is in position, electric current may be supplied to the heater. The heat from the heater heats and liquefies the salt. The system may then be allowed to cool, with the resultant axial reduction in length of the bag and filling of the annulus or wellbore. The salt solidifies and the well or annulus is sealed off. When the service work is completed, the seal element may be reheated with the electrical heater, and it extends in length, decreases in radius and can be removed while maintaining the temperature, for example. Alternately, the seal element may be designed so that the temperature is raised to a point where the expansion tube mechanically latches in the extended position so that it can be removed without the necessity for continual heating.

Wellbore Tubular Patch

In another embodiment, a length of pipe and a eutectic seal element may be installed to form a patch over a selection portion of a wellbore tubular. In such an embodiment, it may be useful to install the eutectic seal element with the bag empty, intending the eutectic to be injected to the bag after positioning the seal, such that the length of pipe may fit with very close tolerance within the wellbore tubular to be patched. In such an embodiment, the eutectic seal element may include a container to carry the eutectic external to the bag and a one-way valve through which the eutectic may be introduced to the bag.

Liner Hanger

Figure 3:
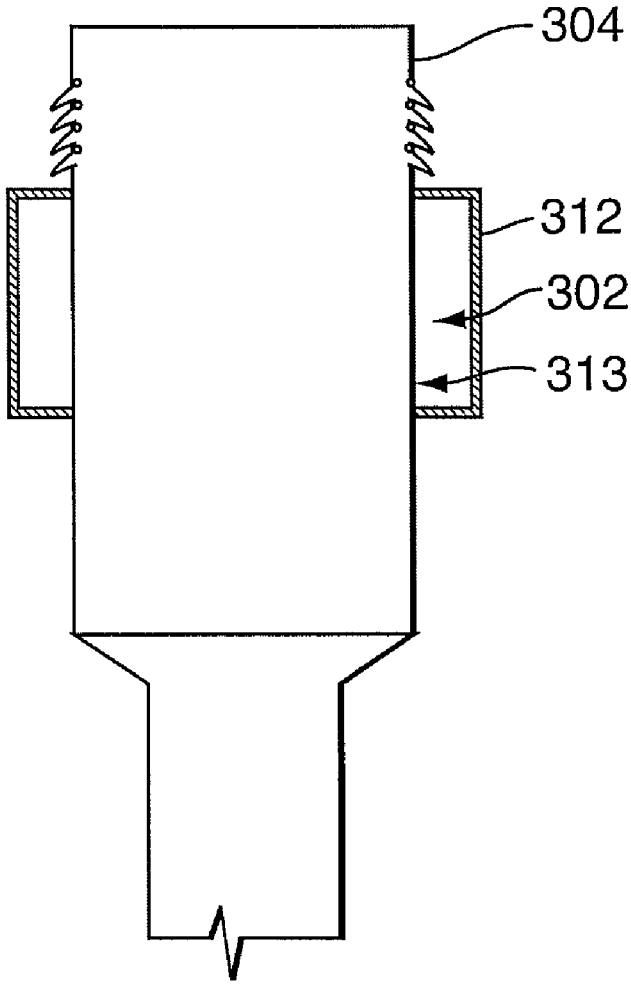
FIG. 3 is a schematic sectional view of wellbore containing a liner hanger and a eutectic seal element.

In another embodiment shown in FIG. 3, the eutectic seal element 302 may be employed on a liner hanger 304, that requires a close tolerance installation but which cannot include a pressure set configuration. In such an embodiment, liner hanger 304 may include a bag 312 installed thereabout below its upper end. The bag may include a eutectic therein or a eutectic may be injectable into the bag after installation, for example from a container through a valve 313, so that the bag may have a most reduced diameter during running in.

Steam Assisted Gravity Drainage (SAGD)

The eutectic seal element may also be used in SAGD applications. In this application, the temperature environment is lower than in huff and puff.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A seal element for a wellbore comprising:
a support member;
a bag positioned on the support member;
a eutectic salt material positionable in the bag; and
an expansion tube retained on an outer surface of the support member and expandable and retractable to move over the support member, the bag connected to the expansion tube in spaced apart positions to move with the expansion tube such that the bag is drawn into a taut position when the expansion tube is expanded and the bag hangs loosely and can flex out to define an enlarged diameter when the expansion tube retracts.

2. The seal of claim 1 wherein the support member comprises a wellbore tubing.

3. The seal of claim 1 wherein the eutectic material is introduced into the bag.

4. The seal of claim 1 wherein the bag is comprised of inelastic material.

5. The seal of claim 4 wherein the inelastic material is comprised of a blend of a poly-paraphenylene terephthalamide and a fluoropolymer.

6. The seal of claim 1 additionally comprising a heater.

7. The seal of claim 6 wherein the heater comprises a heat exchanger.

8. The seal of claim 7 wherein the heat exchanger is mounted on the support member to pass between the support member and the bag.

9. The seal of claim 1 additionally comprising a piston.

10. The seal of claim 1 wherein the expansion tube includes a material responsive to temperatures which causes the expansion tube to expand in length when heated and, after being heated and expanded, to retract as the material cools.

11. The seal of claim 1 wherein bag is connected to the expansion tube by retainers wherein the retainers are slideably moveable along the support member and the retainers are driven to slide along the support member by action of the expansion tube.

12. The seal of claim 1 wherein the expansion tube further comprises helical slots.

13. A method of sealing a wellbore comprising:

positioning a bag in a wellbore in an axially extended position on a support member;

providing a eutectic material contained in the bag;

allowing the bag to flex out away from the support member and assume a flexed condition;

allowing the eutectic material to harden in the bag during the flexed condition to create a seal in the wellbore; and allowing the eutectic to liquefy to open the seal in the wellbore.

14. The method of claim 13 wherein providing the eutectic material in the bag includes introducing the eutectic to the bag prior to positioning.

15. The method of claim 13 wherein providing the eutectic material in the bag includes introducing the eutectic to the bag after positioning.

16. The method of claim 13, wherein while or after the eutectic becomes liquefied, the method further comprises, drawing in the bag toward the support member.

17. The method of claim 16 wherein allowing the eutectic to liquefy and drawing in the bag are both accomplished by raising the temperature in the wellbore adjacent the seal.

18. The method of claim 13, wherein after the eutectic is liquefied to open the seal in the wellbore, the eutectic is repeatedly thereafter hardened and liquefied to recreate and reopen the seal in the wellbore.

19. The method of claim 13, wherein allowing the eutectic to liquefy includes passing steam adjacent the bag to heat the eutectic.

* * * * *